US008240400B2

(12) United States Patent
Peltola et al.

(10) Patent No.: US 8,240,400 B2
(45) Date of Patent: Aug. 14, 2012

(54) NOISE-DAMPENING SHIELD STRUCTURE FOR ROCK DRILLING APPARATUS

(75) Inventors: Seppo Peltola, Tampere (FI); Ari Haavisto, Lempäälä (FI)

(73) Assignee: Sandvik Mining and Construction Oy, Tampere (FI)

( * ) Notice: Subject to any disclaimer, the term of this patent is extended or adjusted under 35 U.S.C. 154(b) by 236 days.

(21) Appl. No.: 12/594,527

(22) PCT Filed: Apr. 4, 2008

(86) PCT No.: PCT/FI2008/050167

§ 371 (c)(1),
(2), (4) Date: Oct. 2, 2009

(87) PCT Pub. No.: WO2008/122696

PCT Pub. Date: Oct. 16, 2008

(65) Prior Publication Data

US 2010/0116555 A1 May 13, 2010

(30) Foreign Application Priority Data

Apr. 4, 2007 (FI) ..... 20075231

(51) Int. Cl.
*E21B 21/015* (2006.01)
*E21B 12/00* (2006.01)

(52) U.S. Cl. ..... 175/315; 175/211

(58) Field of Classification Search ..... 175/211, 175/215, 325.1, 325.5, 315
See application file for complete search history.

(56) References Cited

U.S. PATENT DOCUMENTS

| | | | |
|---|---|---|---|
| 3,667,571 | A | 6/1972 | Fattelay |
| 4,521,232 | A | 6/1985 | Howeth |
| 4,799,556 | A | 1/1989 | Foster et al. |

FOREIGN PATENT DOCUMENTS

| | | | |
|---|---|---|---|
| JP | 5-295978 | A | 11/1993 |
| JP | 2006-022568 | | 1/2006 |
| SE | 523 874 | C2 | 5/2004 |
| SU | 408012 | | 12/1973 |
| WO | 00/39412 | | 7/2000 |
| WO | 2006/038850 | | 4/2006 |
| WO | 2006/038851 | | 4/2006 |

OTHER PUBLICATIONS

English Translation of SU 408012.*
A PCT International Preliminary Report on Patentability completed Jun. 22, 2009 issued in PCT Application No. PCT/FI2008/050167.
International Search Report mailed Jul. 8, 2008 issued in PCT Application No. PCT/FI2008/050167.

* cited by examiner

*Primary Examiner* — David Andrews
(74) *Attorney, Agent, or Firm* — Morgan, Lewis & Bockius LLP

(57) ABSTRACT

The invention relates to a shield structure of a rock drilling apparatus for dampening noise, the rock drilling apparatus comprising a feed beam whose one end is a drilling end, whereby the drilling end of the feed beam comprises a first shield part mounted immovably relative to the feed beam, and a second shield part mounted movably relative to the feed beam. A tubular shield flexible at least in its longitudinal direction is mounted between the shield parts, the shield being tightly attached by its ends to the first and the second shield part.

14 Claims, 1 Drawing Sheet

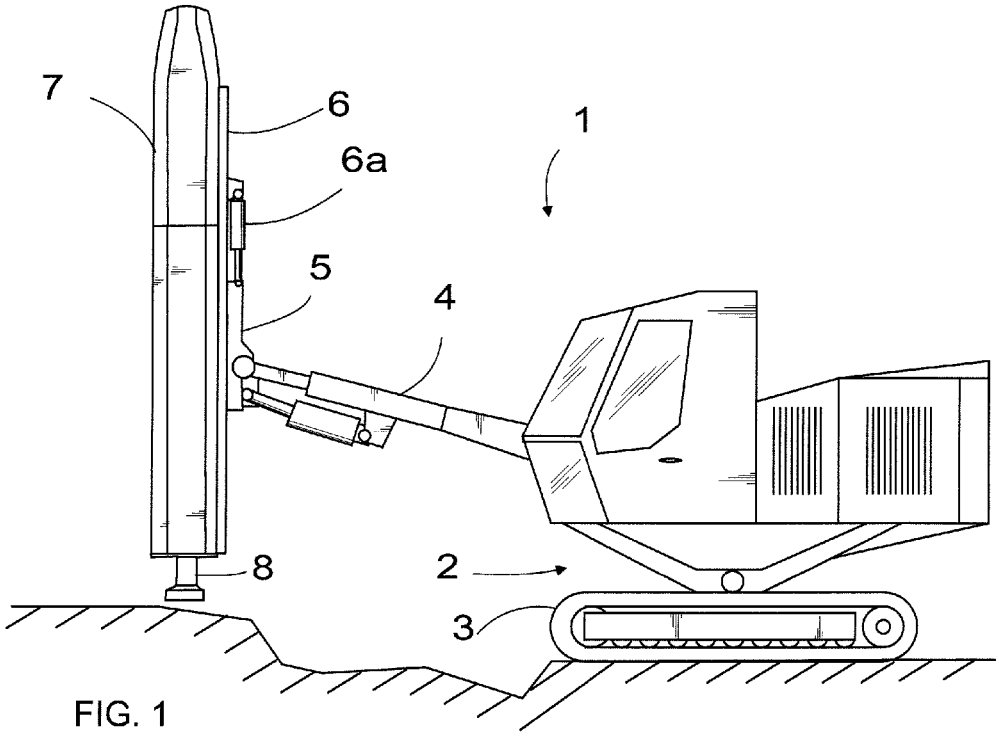
FIG. 1
FIG. 2
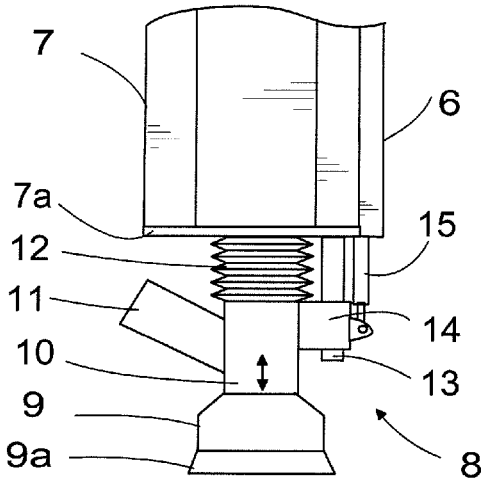
FIG. 3
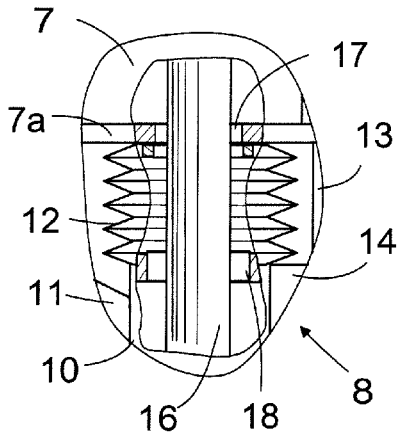

NOISE-DAMPENING SHIELD STRUCTURE FOR ROCK DRILLING APPARATUS

BACKGROUND OF THE INVENTION

The invention relates to a shield structure of a rock drilling apparatus for dampening noise, the rock drilling apparatus comprising a feed beam whose one end is a drilling end, whereby the drilling end of the feed beam comprises a first shield part mounted immovably relative to the feed beam, and a second shield part mounted movably relative to the feed beam in its longitudinal direction, whereby both shield parts comprise an opening through which a drill rod, which is connected to a rock drill moving during the drilling on the feed beam, travels during the drilling.

When drilling rock, drill apparatuses are used which comprise one or more booms mounted on a base, and a drill movably mounted on a feed beam provided on the boom. Often the feed beam is also installed at an end of a boom movably in its longitudinal direction by a separate cradle so as to enable the feed beam to be arranged in a desired position and in a desired direction for drilling. In view of these various movements of the boom and the feed beam, the drill apparatus is provided with various transfer cylinders or hydraulic motors known per se that are driven by pressure fluid.

A typical problem in rock drilling is noise. The noise is produced by a rock drill impacting on the head of a tool and the tool impacting on rock, as well as by various other movements, such as rotation, etc. The noise, which propagates even quite widely to the surroundings, keeps causing more and more problems, particularly in the vicinity of housing areas. In order to prevent the noise from causing restrictions on working hours or sites, attempts have been made to solve the issue particularly in surface drilling by using various noise-dampening housings around the feed beam and the drill. Such solutions are known e.g. from WO 2006/038850, WO 00/39412, SE 523874, U.S. Pat. No. 3,667,571, and JP 5-295978. The problem with all these solutions is that they are difficult to implement or they do not dampen the noise over the entire area of the drill. Particularly the noise dampening at the end of the housing, where the drill bit and the drill rod come out of the housing during the drilling, is not good. There have been attempts to solve this problem, for example in WO publication 2006/038851 with a particular dampening solution, which utilizes two damper tubes mounted in the longitudinal direction of the drill rod movably relative to each other. A problem with this solution is that there remains a gap between the parts, and the dampening is not as efficient as it could be.

BRIEF DESCRIPTION OF THE DRAWINGS

An object of this invention is to provide a shield structure having an improved sound-dampening capacity.

The shield structure according to the invention is characterized in that a tubular shield flexible at least in its longitudinal direction is mounted between the openings of the first and the second shield part, the shield being tightly attached by its ends to the first and the second shield part in such a way that there is a closed space between the openings of the first and the second shield part.

The essential idea of the invention is that the shield structure comprises as a sound damper a tubular shield flexible at least in its longitudinal direction, which shield tightly closes the space between the shield parts in such a way that noise cannot get directly to the surrounding air. According to an embodiment of the invention, the tubular shield is manufactured of elastic material. According to still another embodiment, the tubular shield is formed of bellows that are attached, by one end, to a sound-dampening housing and, by the other end, to a suction nozzle to be placed upon the drill hole. Hence, the suction nozzle can be moved relative to the sound dampening housing in the axial direction of the drill rod, and the bellows protect the drill rod, dampening noise continuously without gaps. The bellows are also easy to mount and thus also easy to change if they get damaged.

BRIEF DESCRIPTION OF THE FIGURES

The invention is described in greater detail in the attached drawings, in which

FIG. 1 shows schematically a rock drilling apparatus having a sound-dampening housing and a shield therein;

FIG. 2 shows a schematic side view of the shield in more detail; and

FIG. 3 shows a schematic partial section view of some details of the shield according to FIG. 2.

DETAILED DESCRIPTION OF SOME EMBODIMENTS OF THE INVENTION

The same parts are denoted with the same numerals in all figures, and they are not explained separately every time unless it is necessary for the sake of clarity.

FIG. 1 schematically shows a rock drilling apparatus 1 provided with a base 2. The base is usually provided with wheels or rollers, in this case by way of example with rollers 3. A boom 4 which, in a manner known per se, may consist of one or more boom parts, in the figure by way of example of one part, is attached to the base 2 in a manner known per se. The boom 4 may be any boom structure known per se; therefore, it is not necessary to explain the boom in greater detail. In a manner known per se but not shown in the figure, the boom 4 is articulated to the base 2 so as to enable the boom to be turned to a desired angle with respect to the base by means of power members known per se, such as pressure medium cylinders or the like.

One of the boom 4 is provided, turnably therewith, with a cradle 5 which, in turn, is provided with a feed beam 6 movable in its longitudinal direction. The feed beam 6 may be moved with respect to the cradle 5 by a pressure medium cylinder 6*a* in a manner known per se. The feed beam 6 is provided with a rock drill known per se, which is not shown, for drilling holes by means of a tool, i.e. a drill rod, and a commonly known drill bit connected thereto. The feed beam and said rock drill as well as part of the drill rod are surrounded by a sound-dampening housing 7. At the drilling end of the feed beam 6, i.e. at the end through which the drill bit and the drill rod push out upon drilling, there is further a shield 8, which will be described in more detail in the context of FIG. 2.

FIG. 2 shows a schematic side view of an embodiment of the structure of the shield 8 in more detail. The lower end of the sound-dampening housing 7, i.e. the drilling head of the feed beam, comprises as the end of the sound-dampening housing a first shield part 7*a* of the shield structure, having an opening for the drill bit and drill rod. The shield 8 comprises a suction nozzle 9 as a second shield part for dust suction and, on the other hand, for sound dampening, which suction nozzle is to be pressed against the surface of the ground or rock during the drilling. The edge of the suction nozzle 9 preferably comprises an edge seal 9*a* made of flexible material and going round the edge of the suction nozzle; this edge seal yields and becomes, when pressed, placed in conformity with the surface of the ground or rock, forming the tightest possible position. Further, the shield 8 comprises a tubular shield part 10 and a suction conduit 11 attached to it. Between the tubular shield part 10 and the sound-dampening housing 7 there are bellows 12, used as a flexible shield member, which are tightly attached by their ends to the end of the sound-dampening housing at one end and to the tubular part 10 of the suction nozzle at the other. There is an open connection from the suction nozzle 9 via the tubular part 10 and correspondingly from the sound-dampening housing via the bellows 12 to the suction conduit 11, via which the drill waste detached from the drill hole is sucked out for recovery with a drill waste exhauster known per se but not shown. Such dust and drill waste exhaustion solutions as apparatuses are known per se, and since they do not essentially relate to the present invention, it not necessary to explain them in greater detail. The tubular part 10 and the suction nozzle 9 as well as the suction conduit 11 are preferably one integrated piece. The tubular part 10 may have a round, angular, elongated or another suitable cross-sectional shape.

The structure further comprises a guide 13 in the longitudinal direction of the feed beam, attached either to the end of the sound-dampening housing 7 or, most preferably, to the feed beam 6. A slide shoe 14 is attached to the nozzle 8, in the figure to the tubular part 10 by way of example. The suction nozzle 9 with its integrated parts is arranged to move, supported by the slide shoe 14, along the guide 13 in the longitudinal direction of the feed beam 6 and thus also the drill rod that is not shown. In this way it can, upon drilling, take its place at a suitable distance from the sound-dampening housing 7 and firmly against the surface while the bellows 12 yield, i.e. become stretched or compressed according to the situation.

The apparatus comprises a separate power member 15 for moving the suction nozzle 9. The power member 15 may be a spring-like member, for example a gas spring that pushes the suction nozzle 9 away from the sound-dampening housing 7, allowing, however, the sound-dampening housing to push towards the suction nozzle when the suction nozzle 9 hits the ground surface. When the drilling apparatus is lifted off the ground, the gas spring pushes the suction nozzle again to the maximum distance from the sound-dampening housing 7. The power member 15 may also be a pressure medium cylinder with which the suction nozzle may be moved towards or away from the sound-dampening housing, whereby the position of the suction nozzle 9 relative to the sound-dampening housing 7 can be adjusted as desired over the whole movement length. Instead of a gas spring or a pressure medium cylinder, conventional spring structures or different mechanical power members, such as screw feed mechanism etc., may naturally be used.

FIG. 3 shows schematically some details of the shield according to FIG. 2. It shows the housing 7 and different parts of the shield 8 as a partial section view. Further, it shows how the drill rod 16 travels from the housing 7 through an opening 17 in the first shield part 7*a* and further through the bellows 12 and an opening 18 in the second shield part 8. The size and shape of the openings 17 and 18 may vary as required.

The invention is illustrated only by way of example in the above description and the drawings, and it is not by any means restricted to this. What is essential is that a tubular shield, preferably bellows, flexible at least in its longitudinal direction, is positioned between the suction nozzle 9 and the sound-dampening housing in the shield, the shield being attached to both the nozzle and the housing by its ends and allowing their movement relative to each other while still keeping the space between the interior space of the sound-dampening housing and the suction nozzle tightly closed, which dampens the noise coming from the sound-dampening housing. The bellows may be of elastic material, such as rubber, plastic etc. Further, they may be manufactured of suitable metal material, provided that they endure the required repetition of movement. The outer edges of the bellows manufactured of elastic material may be protected by metal bands or the like attached to the outer surface of the bellows. The cross-section of the flexible shield may be round, angular, elongated or of another suitable cross-sectional shape. The guide and the power member may also be mounted inside the flexible shield, whereby the slide shoe structure or different slide member structures are naturally also on the same side. Likewise, there may be more than one guide and/or power member.

The invention claimed is:

1. A shield structure of a rock drilling apparatus for dampening noise, the rock drilling apparatus comprising a feed beam, with one end that is a drilling end; a rock drill that moves on the feed beam; a drill rod coupled to the rock drill; and a sound-dampening housing surrounding the feed beam, the rock drill, and a part of the drill rod, the shield structure comprising:

a first shield part mounted immovably relative to the feed beam in the drilling end of the feed beam at an end of the sound-dampening housing; and a second shield part mounted movably relative to the feed beam in its longitudinal direction, whereby both the first and second shield parts comprise an opening through which the drill rod, which is coupled to the rock drill, moves during the drilling, wherein a flexible tubular shield that is flexible at least in its longitudinal direction is mounted between the openings of the first and the second shield parts, the flexible tubular shield being tightly attached by its ends to the first and the second shield parts in such a way that there is a closed space between the openings of the first and the second shield parts, and wherein the shield structure further comprises, a guide oriented in the longitudinal direction of the feed beam and projecting axially from the drilling end of the feed beam at an end of the sound-dampening housing toward the shield structure, wherein the second shield part is connected movably to the guide, and a pressure medium cylinder that affects between the first and the second shield parts to move the second shield part towards and away from the first shield part.

2. The shield structure of claim 1, wherein the flexible tubular shield is bellows.

3. The structure according to claim 2, wherein the flexible tubular shield is manufactured of elastic material.

4. The shield structure according to claim 3, wherein the second shield part comprises a tubular part whose end is directed away from the flexible tubular shield and is provided with a suction nozzle for sucking drilling waste during the drilling, and a suction conduit is connected to the tubular part for a suction tube of a drill waste exhauster.

5. The shield structure according to claim 3, wherein the first shield part is the end of the sound-dampening housing surrounding the rock drill.

6. The shield structure according to claim 1, wherein the flexible tubular shield is manufactured of elastic material.

7. The shield structure as in any one of claims 1, 2, and 6 wherein the second shield part comprises a tubular part whose end is directed away from the flexible tubular shield and is provided with a suction nozzle for sucking drilling waste during the drilling, and a suction conduit is connected to the tubular part for a suction tube of a drill waste exhauster.

8. The shield structure according to claim 7, wherein an edge of the suction nozzle comprises an edge seal made of elastic material and going round the edge of the suction nozzle.

9. The shield structure according to claim 8, wherein the first shield part is the end of the sound-dampening housing surrounding the rock drill.

10. The shield structure according to claim 7, wherein the first shield part is the end of the sound-dampening housing surrounding the rock drill.

11. The shield structure as in any one of claims 1, 2, and 6, wherein the first shield part is the end of the sound-dampening housing surrounding the rock drill.

12. The shield structure according to claim 1, wherein the second shield part is connected to and movably supported by a slide shoe to the guide.

13. The shield structure according to claim 1, wherein the rock drilling apparatus further comprises a boom provided, turnably therewith, with a cradle which, in turn, is provided with the feed beam movable in its longitudinal direction.

14. The shield structure according to claim 1, wherein the guide is attached either to the feed beam or the sound-dampening housing.

* * * * *